US009605520B2

(12) United States Patent
Blount et al.

(10) Patent No.: US 9,605,520 B2
(45) **Date of Patent: *Mar. 28, 2017**

(54) IN-SITU ZONAL ISOLATION AND TREATMENT OF WELLS

(71) Applicant: CONOCOPHILLIPS COMPANY, Houston, TX (US)

(72) Inventors: Curtis G. Blount, Katy, TX (US); John C. Braden, Anchorage, AK (US); Dan E. Venhaus, Chugiak, AK (US)

(73) Assignee: ConocoPhillips Company, Houston, TX (US)

( * ) Notice: Subject to any disclaimer, the term of this patent is extended or adjusted under 35 U.S.C. 154(b) by 694 days.

This patent is subject to a terminal disclaimer.

(21) Appl. No.: 13/743,498

(22) Filed: Jan. 17, 2013

(65) Prior Publication Data

US 2013/0126162 A1 May 23, 2013

Related U.S. Application Data

(63) Continuation-in-part of application No. 12/694,082, filed on Jan. 26, 2010, now Pat. No. 8,403,047.

(51) Int. Cl.

| | |
|---|---|
| ***E21B 43/04*** | (2006.01) |
| ***E21B 43/08*** | (2006.01) |
| ***E21B 43/10*** | (2006.01) |
| ***E21B 43/12*** | (2006.01) |
| ***E21B 43/14*** | (2006.01) |

(52) U.S. Cl.
CPC ..... *E21B 43/12* (2013.01); *E21B 43/04* (2013.01); *E21B 43/14* (2013.01)

(58) Field of Classification Search
CPC ..... E21B 43/04; E21B 43/08; E21B 43/045; E21B 43/14; E21B 43/10; E21B 43/12; E21B 43/108; C09K 8/56
See application file for complete search history.

(56) References Cited

U.S. PATENT DOCUMENTS 8,403,047 B2 * 3/2013 Blount ..... E21B 43/04 166/192

* cited by examiner

*Primary Examiner* — Zakiya W Bates
(74) *Attorney, Agent, or Firm* — Boulware & Valoir

(57) ABSTRACT

A process for isolating one or more segments of a gravel packed well from other segments to treat the isolated segments and easily re-establish flow from the other segments after the treatment is described. The treatment includes techniques for enhancing or permanently blocking production from the isolated segment. The process includes the installation of a removable sealing element and a permeability poison that forms a fluid seal to prevent longitudinal fluid flow along the annular production space outside the tubular production pipe. With wireline or other low-cost wellbore workover systems, access is re-engaged with the secluded formation including removal of plugs and fluid seals within the tubular production pipe.

22 Claims, 6 Drawing Sheets

IN-SITU ZONAL ISOLATION AND TREATMENT OF WELLS

CROSS-REFERENCE TO RELATED APPLICATIONS

This application is a continuation in part to application which claims benefit under 35 USC §120 to U.S. application Ser. No. 12/694,082, filed Jan. 26, 2010, entitled "In-Situ Zonal Isolation For Sand Controlled Wells," which is incorporated herein in its entirety.

FIELD OF THE INVENTION

This invention relates to producing fluids from a gravel packed well.

BACKGROUND OF THE INVENTION

In oil wells, it is common for sand or other solid gritty materials to be carried from the producing formation along with the oil into the wellbore. Sand or other grit causes problems and wear for the production equipment and preventing the introduction of such solids into the wellbore is very much desired. A common solution to prevent the production of such sand and grit is called "gravel-packing" the well. Gravel packing is basically the installation or packing of a filter media into the annular space between the production tubing/liner and the casing or the formation in an open-hole production arrangement. This filter media is often clean, well sorted sand or gravel, but may be any other material which acts to prevent production of formation sand and grit. As used herein, filter media may include any material in the area between the wellbore and reservoir that restricts movement of reservoir solids into the wellbore, which may be an integral part of the completion (screen) or placed as part of completion procedure (pumped in media). This 'gravel packed' space extends along the outside of the production tubing/liner or casing, and maybe the length of hundreds of pipe sections or joints. While most of the production tubing or casing is impervious to liquid, the sections or joints adjacent the production zone are provided with slots or other pre-perforated openings in the peripheral wall. These joints allow the produced liquids to pass from the outside of the production tubing or casing into the interior of the production tubing or casing. These slotted or pre-perforated joints are often screened and/or pre-packed with sand control media and known to those skilled in the art as sand control screens. The interior of the production tubing or casing is where a pump may be disposed to carry or drive the liquids to the surface. Those that are skilled in the art understand that there are a lot of different production methods including free flowing and plunger lift as well as several variations of artificial lift such as gas lift, rod pumps, rotary PC pumps, jet pumps, electric submersible pumps and there are other less common methods of production methods.

The slotted or pre-perforated joints are commonly referred to as sand control equipment which is typically comprised of a base pipe that typically includes holes or openings with a wire mesh, screen, or pre-packed sand control media around the outside to prevent the filter media from leaking into the production tubing/casing. There are other gravel packing arrangements where the base pipe has many small slits that are sized to prevent the passage of sand, but the function is substantially the same. Gravel packing essentially forms a filter barrier for the fine formation sand or grit, but allow the liquids to pass freely through the interstices into the production tubing/casing and be carried to the surface. However, the filter media does not discriminate between different fluids and there are times when undesirable fluids enter the gravel packing. For example, as a well is produced, water, especially salt water, often encroaches into the hydrocarbon production zone as hydrocarbons are extracted. Typically, hydrocarbons and water are found together underground with water below oil. As the hydrocarbons are withdrawn, the hydrocarbon/water interface rises and it is not uncommon for water to begin to comprise a significant portion of the total fluids produced. However, water can enter virtually anywhere in the completion in the well depending on the geological conditions. Water may enter the mid to upper sections of a producing zone when the upper sections have higher permeability and when the permeability ratios (vertical vs. horizontal) or natural formation fractures favor a situation where water may over-run the tighter producing zones and show up first in mid to upper areas of the completion.

While the hydrocarbon/water interface may initially be confined to a single production zone, it is also not uncommon for an oil well to be drilled such that several hydrocarbon bearing zones are accessed by the single well. Each of the hydrocarbon bearing zones may be isolated from one another by impermeable rock formations and each may have and hydrocarbon/water interface. The gravel packing may be exposed to several of these formations and fluids from one may translate along the gravel packing media to enter the production tubing at a different location. This can be a concern as allowing different isolated zones to communicate with one another may create undesirable problems in that one zone may contaminate another. The separate zones may extend for miles so cross contamination may have broad consequences.

There have been several efforts to stop the production of water in gravel packed wells. Typically, the formation pressure that drives the hydrocarbons toward the low pressure well comes from salt water that is denser than hydrocarbons and, therefore, below the hydrocarbons. As such, the efforts have been focused on closing the gravel packed bed from the water at the bottom of the production zone. What hasn't been developed is a suitable and effective technique to seal the well from undesirable fluids that are above or in the middle of the target zone while permitting continues production from the target zone.

BRIEF SUMMARY OF THE DISCLOSURE

The invention generally includes a process for isolating and treating a first fluid producing zone of an underground formation in an earthen well where the well includes a second fluid producing zone and a filter media within an annular production space between a tubular production pipe and the underground formation or casing pipe where access from the surface through the production pipe to the second fluid producing zone is preserved for subsequent production following the isolating and treating procedure. The process more particularly includes installing a removable sealing element into the tubular production pipe at a level further into the ground than the first fluid producing zone. The removable sealing elements may be installed using wireline, coiled tubing, jointed pipe, or other methods commonly known in the industry. A settable, low viscosity permeability poison is injected into the tubular production pipe above the plug and out into the filter element in the annular production space outside of the tubular production pipe and extending to the casing pipe or formation to fill a segment of the filter media in the annular production space between the first and second fluid producing zones to eventually separate and substantially seal the first and second zones from one another against fluid flow in the filter media in the annular production space. The low viscosity permeability poison is converted into a fluid seal forming a barrier against flow within the sand control screen in the annular production space and a treatment is injected into the tubular production pipe onto the fluid seal and through the annular production space and into the formation at the first fluid producing zone. The interior of the tubular pipe is then opened up to regain access to the second fluid producing zone by removing portions of the treatment material, the fluid seal and the isolation material within the tubular production pipe so that fluids may enter the production pipe from the second zone and be extracted to the surface past the now treated first fluid producing zone.

A variation of the present invention is a process for isolating and treating first and second fluid producing zones of an underground formation in an earthen well that includes a third fluid producing zone generally intermediate of the first and second zones where the second zone is most distant from the surface and the first zone is closest to the surface and the well also includes a filter media—with an annular production space between a tubular production pipe and the underground formation or casing pipe where access from the surface through the production pipe to the third zone is preserved for subsequent production following the isolating and treating procedures of the first and second zones. This variation includes installing a removable sealing element into the tubular production pipe at a level further into the ground than the second fluid producing zone and injecting a treatment into the tubular production pipe which is sealed by at least the plug and through the annular production space and into the formation at the second fluid producing zone. A layer of isolation material is deposited into the tubular production pipe above the plug to form a first low permeability layer therein where at top of the layer is at a level below the first fluid producing zone. A first settable, low viscosity permeability poison is injected onto the isolation material in the production pipe and out into the filter media in the annular production space outside of the tubular production pipe and extending to the casing pipe or formation to fill a segment of the filter media in the annular production space between the first and second fluid producing zones to eventually separate and substantially seal the first and second zones from one another against fluid flow in the filter media in the annular production space. The low viscosity permeability poison is then converted into a fluid seal forming a barrier against flow within the sand control screen in the annular production space. A treatment may then be injected into the tubular production pipe onto the fluid seal and through the annular production space and into the formation at the first fluid producing zone and then the interior of the tubular production pipe is opened up to regain access to at least the third fluid producing zone by removing portions of the treatment material, the fluid seal and the isolation material within the tubular production pipe so that fluids may enter the production pipe from the third fluid producing zone and be extracted to the surface past the now treated first fluid producing zone.

A further variation of the present invention is a process for isolating and treating a fluid producing zone of an underground formation in an earthen well that includes at least one additional fluid producing zone and the well also includes a filter media with an annular production space between a tubular production pipe and the underground formation or casing pipe where access from the surface through the production pipe to the additional fluid producing zone is preserved for subsequent production following the isolating and treating procedures of the fluid producing zone. The variation includes installing a removable sealing element into the tubular production pipe at a level further along than the additional fluid producing zone. A treatment may be injected into the tubular production pipe which is sealed by at least the plug and through the annular production space and into the formation at the additional fluid producing zone. A layer of isolation material may be deposited into the tubular production pipe before the plug to form a first low permeability layer therein where the layer is after the fluid producing zone. Injecting a first settable, low viscosity permeability poison onto the isolation material in the production pipe and out into the filter media in the annular production space outside of the tubular production pipe and extending to the casing pipe or formation to fill a segment of the filter element in the annular production space to eventually substantially seal the fluid producing zone against fluid flow in the filter media in the annular production space. The low viscosity permeability poison may be converted into a fluid seal forming a barrier against flow within the sand control screen in the annular production space. Injecting a treatment into the tubular production pipe onto the fluid seal and through the annular production space and into the formation at the fluid producing zone. Opening up the interior of the tubular production pipe to regain access to at least the additional fluid producing zone by removing portions of the treatment material, the fluid seal and the isolation material within the tubular production pipe so that fluids may enter the production pipe from the third fluid producing zone and be extracted to the surface past the now treated fluid producing zone.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow. While the figures show vertical wellbores, the process of isolating and treating wellbores is not limited to vertical wellbores and can be applied to wellbores of any angle.

Figure 1:
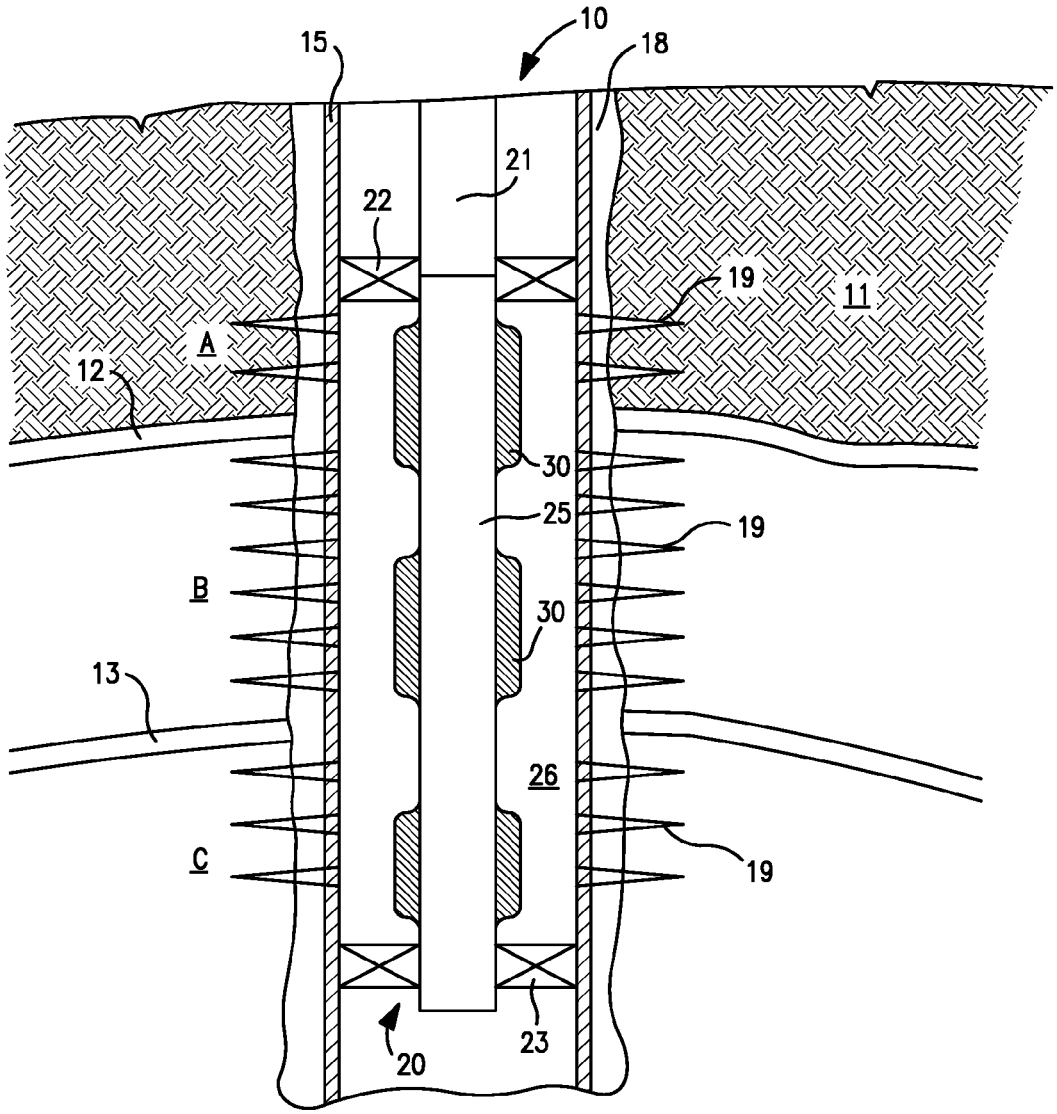
FIG. 1 is a vertical and fragmentary cross sectional view of a not to scale prior art production system in a borehole.

Turning to FIG. 1, a wellbore 10 is shown to be formed deep into the earth 11. Within the earth 11 are layers of various materials. Some of the layers are porous and permeable and permit fluids such as oil and water and natural gas to transit through the pores and interstitial voids. These layers are sometimes described as reservoir rock as the oil or hydrocarbons tend to move through permeable formations. Other layers in the earth are either without pores or have closed pores and do not permit fluids to easily pass through. These layers tend to seal one permeable layer from another and certain geological structures may capture and hold oil and other hydrocarbons in areas called "traps". Those deciding where to drill tend to target these hydrocarbon traps and produce oil where it is found in quantities that justify the investment to produce it.

In FIG. 1, a wellbore is generally indicated by the numeral 10 and is shown to have encountered three permeable zones, labeled A, B and C. Between zones A and B is shown an impermeable or substantially impermeable layer 12. Between zones B and C is shown an impermeable or substantially impermeable layer 13. The wellbore 10 was drilled with a diameter large enough to accommodate casing pipe 15. As is well known in the oil business, casing pipe 15 is inserted into position in the wellbore 10 and sealed to the earth 11 and to all the various zones and layers that the wellbore 10 intersects by cement or other grout material that forms a layer 18 around the outside of the casing pipe 15. The wellbore 15 is also shown to have been perforated by known perforating techniques that typically include shaped charges detonated to form a number of openings through the casing pipe 15 and through the cement layer 18 and also into the earth and into the various layers and zones therein. In the present illustration, the perforations are illustrated as conical shaped perforations 19 with the pointed ends extending into the earth in each of the permeable zones A, B and C. In actuality, perforations take various indescribable shapes with many fractures and fissures to allow and encourage fluids to drain from the formation into the wellbore 10. With the perforations 19 extending through the wall of the casing pipe 15 and all the way into the formations of the earth 11, oil and other fluids in the permeable zones A, B and C are able to move through from the permeable zones and into the wellbore 10 until the pressure of the fluid inside the wellbore equalizes with the pressure in the various permeable zones A, B and C.

While there are situations where the formation pressure is sufficient to drive hydrocarbons to the surface, it is more typical for fluids in the wellbore 10 to be extracted through a production assembly that includes any of various forms of artificial lift including down hole pumps. The production assembly is generally indicated by the numeral 20 and the pump or other form of artificial lift is not shown. While conventional production systems can include a substantial number of elements and provide substantial capability at the bottom of a wellbore, the production assembly 20 is simplified to provide an explanation of the invention and the problems that the invention is intended to overcome. The simplified production assembly 20 includes a production pipe 21 having sand control screen base pipe 25 arranged to be in the vicinity of the producing zones of the wellbore 10. The production pipe 21 and sand control screen base pipe 25 are connected end to end with an upper packer 22 and a lower packer 23 arranged to seal an annular production space 26 within the interior of the casing pipe 15 and around the sand control screen base pipe 25 possibly including part of the production pipe 21. It should be noted that sand control base pipe is little more specialized than tubing in that sand control base pipe may include wrapping screens, sand, resin coated sand, sintered metal or other filter materials. A typical sand control screen's base pipe is perforated or slotted through the majority of the length of the pipe joint. While it is not clear from the drawings, a joint is typically thirty feet or so in length and the perforations and slots may extend the entire length but for several inches from each end so as not to interfere with the collars where the joints are connected. Filter media is applied over the pre-perforated or slotted base pipe and the ends of each joint of base pipe may be indistinguishable from regular tubing joints. In FIG. 1, the sand control base pipe 25 has apertures, holes, perforations, slots or similar to allow fluids to pass from the outside to the inside while the production pipe 21 has an impervious wall. The packers 22 and 23 are arranged so that all of the openings in the sand control base pipe 25 and all of the perforations 19 are open to the production space 26 defined between the packers 22 and 23 and no openings in the sand control base pipe 25 nor any perforations 19 are outside of the production space 26.

It should be noted that while the well 10 in the illustrated example is provided with casing pipe 15, the invention is also applicable for open-hole production systems where the production space 26 extends from the production pipe 21 to the formation or to the inner wall of the wellbore 10. Open-hole production is well known and generally much less expensive than cased production. However, for simplicity in the explanation, the invention is described with casing pipe 15 with the expectation that those skilled in the art will readily understand that the inside of the casing pipe 15 is a substitute for the inner wall of the wellbore 10 and that without the casing pipe 15, the invention could be directly undertaken with the production space 26 extending fully to the inner wall of the wellbore 10.

Figure 2:
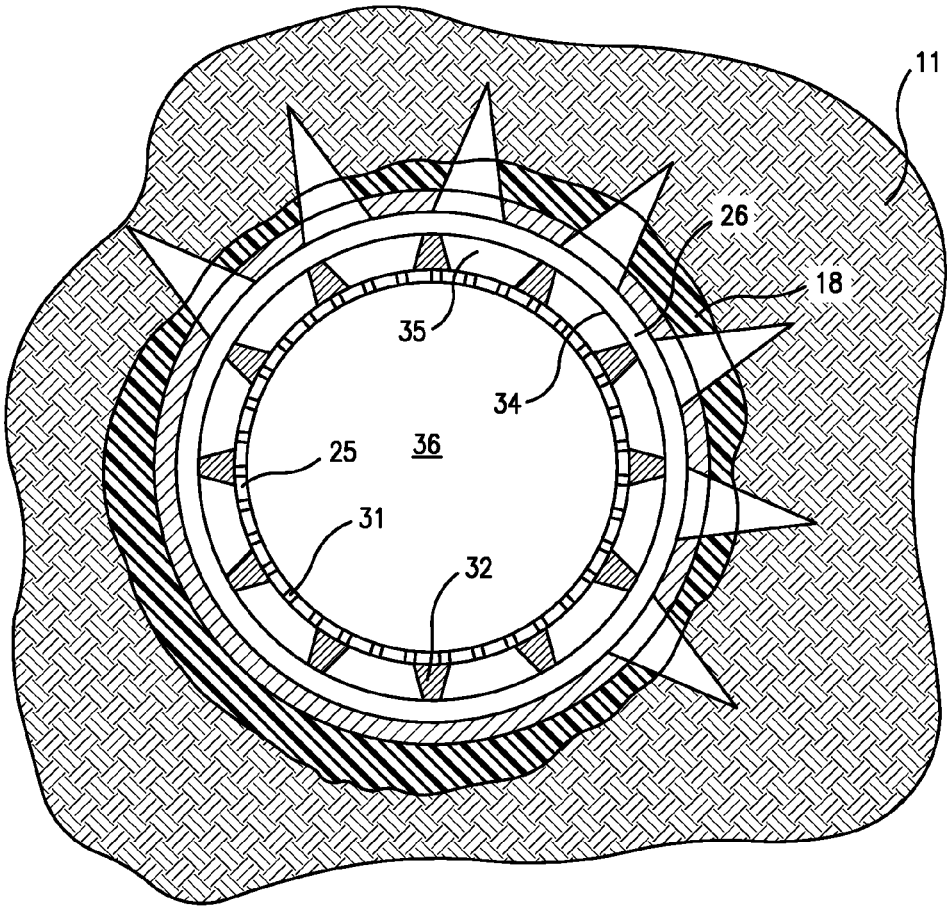
FIG. 2 is a top and fragmentary cross sectional view of a not to scale prior art production system in a borehole.

The sand control base pipe 25 as illustrated includes three production sections 30 which are best explained in conjunction with FIG. 2. Turning to FIG. 2, base pipe 25 includes a large number of openings 31 to allow fluids to pass from the production space 26 into the interior 36 of the base pipe 25. Around the outside of the base pipe 25 are a number of spacers 32 which are generally welded to the exterior of the base pipe 25. Surrounding the base pipe 25 and spaced from the periphery thereof is a wire wrapped screen 34. In other configurations such as with extruded metal, ceramics retention filters or combinations thereof, it should be noted may not include spacers and a space 35 around the sand control base pipe 25, but the invention will still generally work the same. The wire wrapped screen 34 creates a large number of small channels through which oil or other fluids may transit from the production space 26 on a path toward the interior 36 of the sand control base pipe 25. Between the casing pipe 15 and the wire wrapped screen 34 is the production space 26 that is typically packed with sand or gravel. It is preferred that with certain types of completion, the filter media also fill the perforation tunnels 19 and the space 35. It should be noted that in certain circumstances, it is very difficult and expensive to fully pack the space around the wire wrapped screen. In these circumstances the formation is allowed to collapse around those portions of the screen over time relying on the screen to keep the sand and grit out of the production tubing. While this is not optimal because the particle sizes against the wire wrapped screen are preferably of a common and selected size to provide maximum porosity while filtering the sand and grit, oil may still be profitably produced and the invention may still be used in this circumstance to isolate portions of the well from other portions. The production space 26 when packed with filter media is sometimes called "gravel packing" or a "packed bed". The mesh size of the wire wrapped screen, woven mesh screen, stacked rod screens, scintered metal, reticulated ceramic or other premium screens, or combinations thereof, 34 is determined in conjunction with the mesh size of the filter media so that the filter media will not pass through the wire wrapped screen 34, sintered metal, reticulated ceramic or combinations thereof, but oil and other fluids may. The gravel or sand basically forms a filter cake that effectively filters any sand or other grit that may be carried by the produced fluids to the perforations 19. The fluids continue to travel toward the interior 36 of the base pipe 25, but the formation sand and grit is held back by the filter media in the production space 26.

The process of installing the casing pipe 15, the production assembly 20 including the gravel bed in the production space is all well known. It is only illustrated to set forth what may be accomplished by the present invention. And the primary concern that the present invention addresses is the circumstance when one or more of the production zones A, B or C begins to deliver amounts of undesirable fluids that justify investments into the well to reduce the production of such undesirable fluids. Typically, when an oil or gas well produces a large percentage of water, the costs of lifting, separating and disposing of the produced water can justify the costs of re-working a well to reduce the percentage of produced water at the producing zone of the wellbore 10. By the present invention any portion of the earth formation may be isolated from the production assembly 20 whether the preferred production zone is above, below or between unpreferred production zones. Water production in either oil or gas wells negatively impacts the production rate of the preferred hydrocarbons. Water can take up a large percentage of the flow path reducing the amount of hydrocarbons produced in a given amount of time, and increasing frictional pressure drop and increasing density of the produced fluids thereby reducing the amount of production due to reduced pressure drop at the formation face. It should also be noted that isolating portions of wells is not limited to hydrocarbon production. In wells that are drilled for fresh water, it is possible to have salt water or contaminated fluid in adjacent formations that can be isolated from the desired zone by the present invention.

To most clearly explain the invention, the illustrated wellbore 10 will be sealed off from zone A and will continue to produce only zones B and C after zone A has been fully closed off from the production assembly 20. This would be appropriate if zone A had suffered a water breakthrough where very little hydrocarbons could be extracted. At the same time, the production from zones B and C would need to be deemed sufficiently profitable to continue producing from those zones through wellbore 10. Issues of profitability for zones B and C include current and projected prices for hydrocarbons, the quality of the hydrocarbons, the contaminants that may make the hydrocarbons less valuable, the remaining water cut or percentage of water in the hydrocarbons, the depth of the well and the cost of isolating zone A, the cost of transporting the produced fluids to market and perhaps a dozen other issues. Regardless, human judgment would dictate which wells and which zones would have the inventive procedure implemented thereon.

Figure 3:
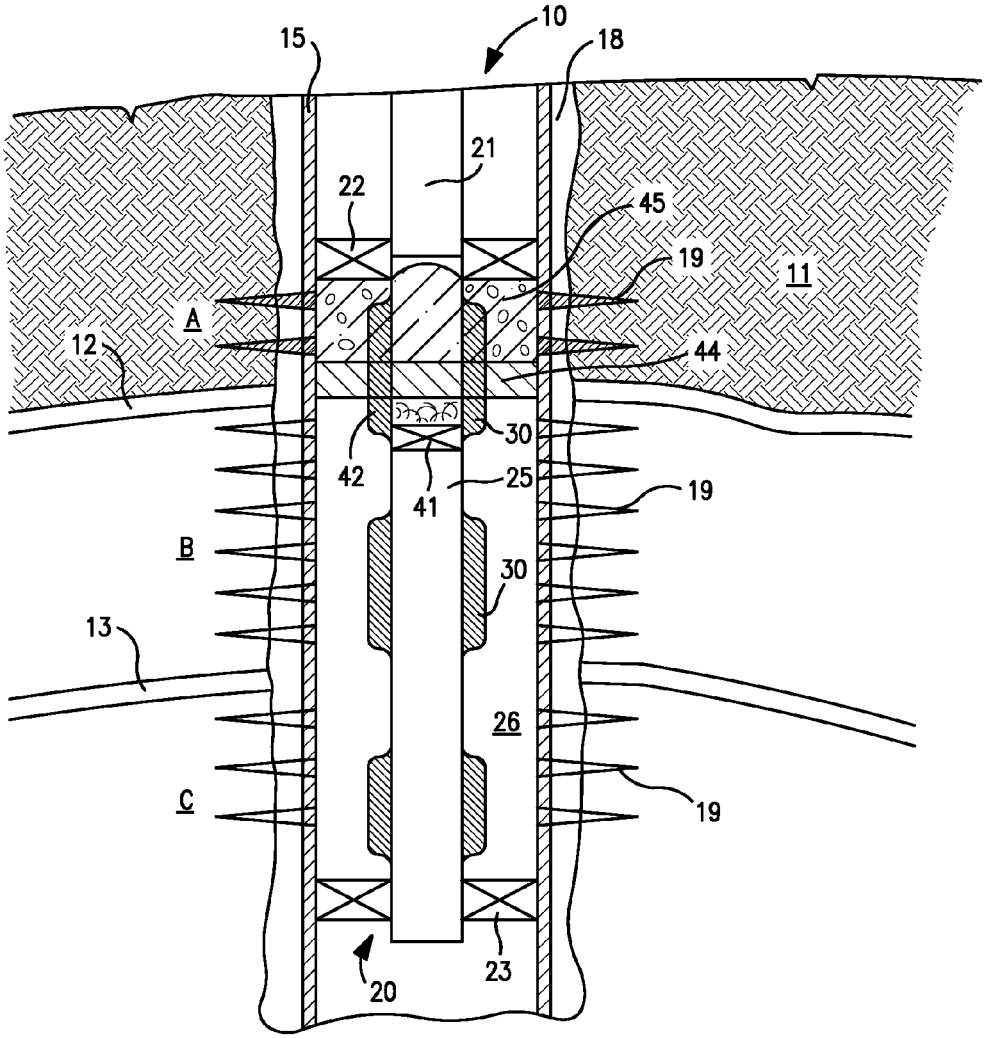
FIG. 3 is a vertical and fragmentary cross sectional view of a not to scale production system in a borehole showing the first steps in a process to isolate a non-preferred upper zone in the well

Turning to FIG. 3, the process of isolating zone A would begin by installing a removable sealing element 41. The removable sealing element functions to seal or prevent flow. Preferably, removable sealing element 41 may comprise a material that can be washed away with a chemical treatment such as an acid wash. Alternatively, a removable sealing element that may be retrieved with a wireline device is suitable or the plug may be drilled/milled out. The removable sealing element may be a removable sealing element, a packer, or an inflatable packer. The removable sealing element 41 is positioned below the zone to be isolated. In FIG. 3, the plug 41 is shown to be below the impermeable layer 12 and therefore below zone A. A layer 42 of isolation material such as fine grain sand, ground calcium carbonate, salt, or other materials including even dense fluids, is then deposited upon the plug 41. The layer 42 of isolation material forms a very low permeability or density balanced barrier to prevent materials that are delivered into the wellbore subsequent to the installation of layer 42 from binding to the plug and complicating the subsequent removal of the plug. The isolation material may be washed out later by circulating fluid or jetting fluid to allow access to the plug as will be discussed later.

It should be noted that the function of the plug as described here within may be accomplished in other ways. One alternative method to deliver the permeability poison and/or the treatment would include dual removable sealing elements, such as treating packers or inflatable packers which are released upon delivery of the desired materials.

A low viscosity permeability poison is injected into the production tubing 21 and delivered onto the layer 42 so as to flow out of the base pipe 25 and into the annular production space 26 all the way to the inside of the casing pipe 15 to form a fluid seal 44. The fluid seal 44 is preferably formed by materials that flow through the gravel packing and preferably seal against the interior of the casing pipe 15 and fill the interstices of the filter media and in certain configurations, the permeability through the screen itself. There are known materials that are able to serve the purpose that with the addition of small amounts of a setting compound, heat, or time will rapidly set from a low viscosity fluid to a very high viscosity or crystalline structure. Essentially, this poison converts permeable filter media into impermeable filter media. Preferred materials include sodium silicate or sodium metasilicate which is a stable and low viscosity liquid in neutral solutions, but in acidic or alkaline solutions converts to form a solid precipitate or high viscosity fluid that that kills or poisons the permeability of the gravel pack rendering it nearly impermeable to flow fluid. Other materials include ultrafine cement, ringing gels, crosslinked liquids, polymerizing liquids, precipitating liquids or combinations thereof. With fluid seal 44 set in place, the production space 26 is now divided. As such, the upper zone A is available for treatment independent of zone B. Some treatments, such as an acid wash or fracturing with additional proppant to enhance fluid production. For example, asphalts or scale build up in the formation and perforations impeding production. In other circumstances, it is desired to slow or stop fluid production. Such production stopping may include the application of substantial forces that may be applied after the fluid seal is fully set.

A permanent barrier to prevent the flow of fluids in zone A from entering production assembly 20 is shown in FIG. 3. Rather than direct the low viscosity materials of the fluid seal 44 into the formation accessed by the perforations 19 into the earth at zone A, the fluid seal 44 is arranged below the lowest perforations in zone A. With the fluid seal 44 in place and set to have a very high viscosity or particulate fluid seal 44, the production blocker 45 may be squeezed at a very high pressure to overcome the inherent formation pressure within zone A and drive the formation blocker 45 through the interstices of the gravel packing and deep into the crevices and fractures within perforations 19. The production blocker may comprise a micro cement, a resin and may also comprise sodium silicate. Under the higher pressure that may be applied with fluid seal 44 in place, the production blocker 45 is able to more fully fill the production spaces including the perforations 19 even if the materials are the same. Referring now to FIG. 2, it should be noted that it is preferred that the space 35 includes the sand and permeability poison to isolate the zones so that fluids are not able to bypass the seal and pass longitudinally along the sand control base pipe 25 in space 35.

Figure 4:
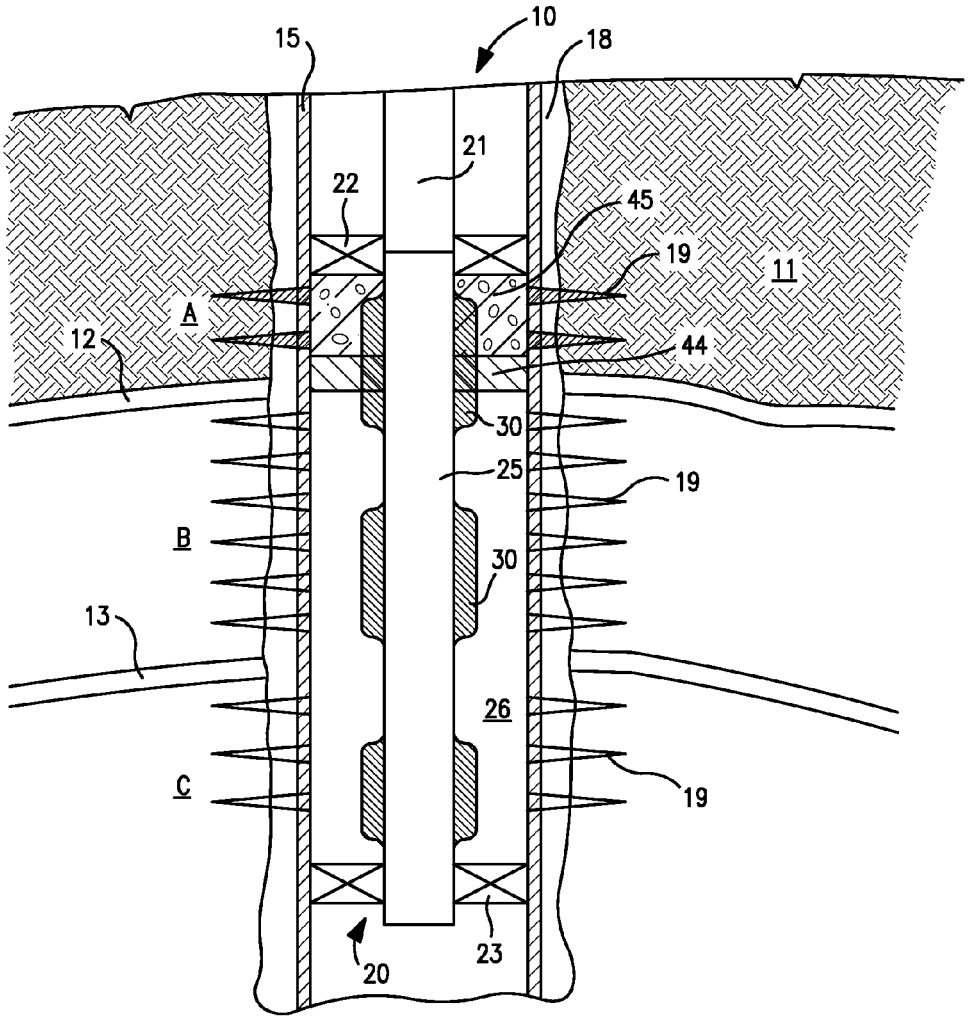
FIG. 4 is a vertical and fragmentary cross sectional view of a not to scale production system in a borehole showing the completed process for isolating a non-preferred upper zone in the well where the preferred zone is below the isolated zone.

The next steps of process relate to opening up fluid communication between the production pipe 21 and the sand control base pipe 25. Referring now to FIG. 4, the materials that form the production blocker 45 are removed from inside the base pipe 25 preferably by irrigation with a circulation of liquids. Chemical treatments such as by directing a stream of suitable acid or caustic through a coiled tubing string or other work string where the dissolved portions of the production blocker 45 and fluid seal 44 are washed up to the surface through the annulus of the production pipe formed outside the coiled tubing string. It should be noted that if water is a suitable material for removing the barrier or production blocker within the interior of the base pipe 25, water would be preferred over other more expensive and harsher chemicals. Moreover, these elements may also be drilled out or may be recovered immediately following the treatment on the treating string. The coiled tubing string or other work string is not shown, but rather the results of the removal of the portions of the production blocker 45, the fluid seal 44, the isolation layer 42 and the plug 41 within the production pipe are removed. At the same time, the perforations 19 in zone A are blocked from further production and the system for blocking does not allow fluids from zone A to bypass the fluid seal 44 and blocker 45 because of the cement 18, the permeable layer 12. Leaving the fluid seal 44 in place provide extra confidence that fluids in zone A are not allowed to move along a narrow interface of the blocker 45 and the lowest perforations 19 and then descend within the gravel pack to be then drawn into the base pipe 25 through a production section 30.

Figure 5:
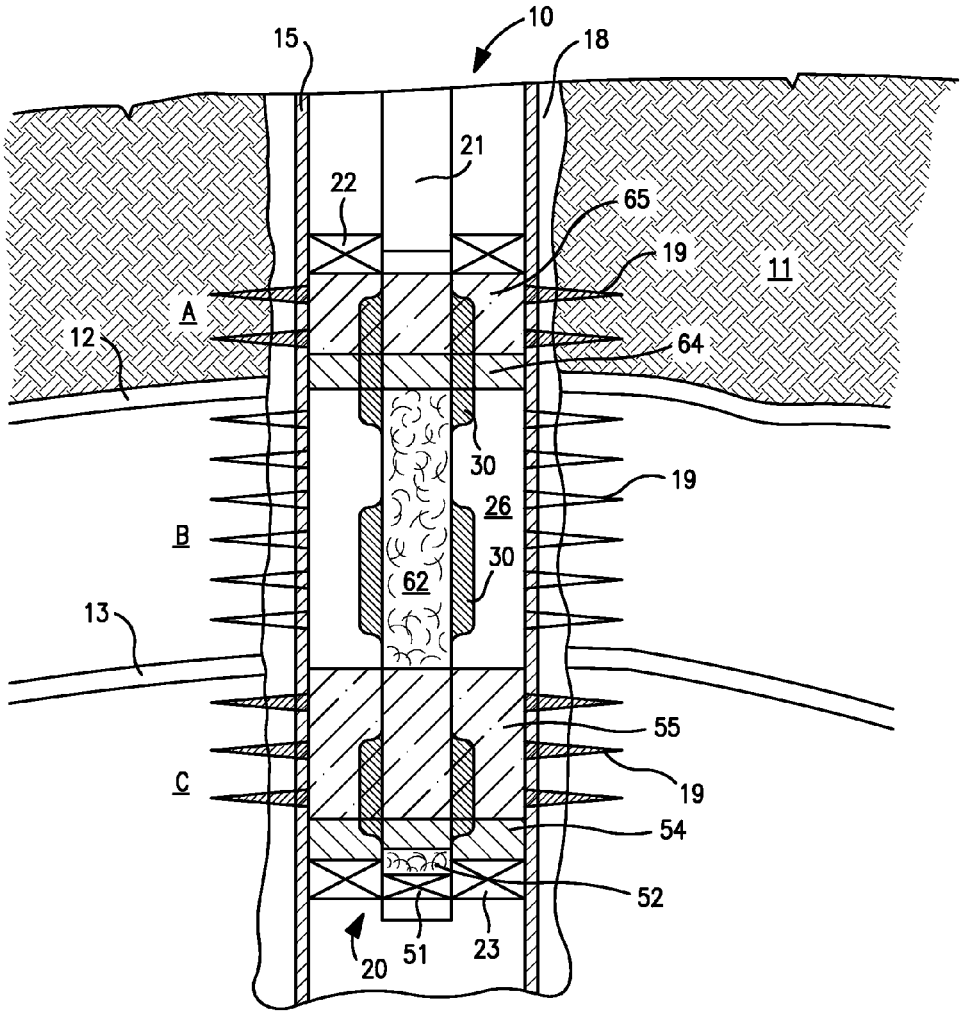
FIG. 5 is a vertical and fragmentary cross sectional view of a not to scale production system in a borehole showing the first steps in a process to isolate a non-preferred upper zone and a non-preferred lower zone in the well.
Figure 6:
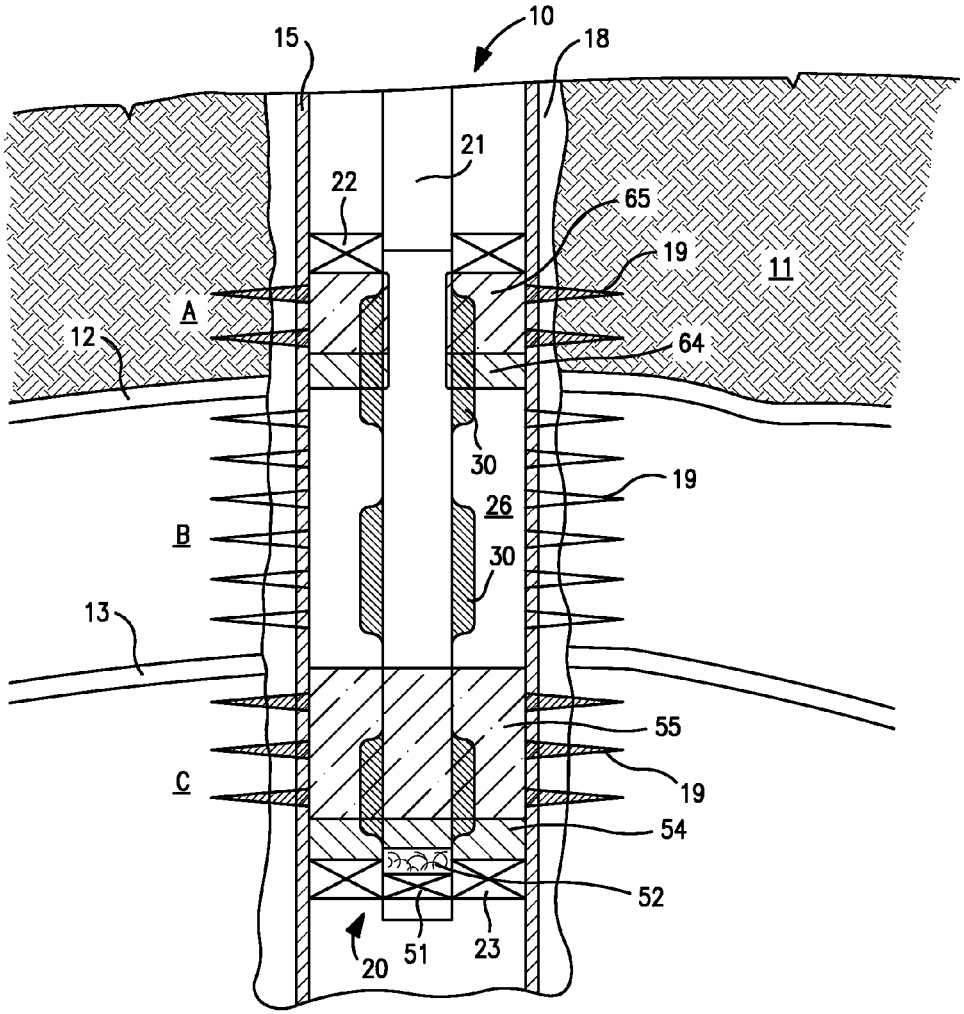
FIG. 6 is a vertical and fragmentary cross sectional view of a not to scale production system in a borehole showing the completed process for isolating two non-preferred zones where the preferred zone is below at least one of the isolated zones.

A similar procedure may be used to isolate zone A and C from zone B where zone B is producing desirable fluids but zones A and C are in need of treatment to enhance production or to be shut off. Referring now to FIG. 5, a removable sealing element 51 is installed below the lowest perforation 19 in zone C. A low permeability isolation layer or high density fluid layer 52 may be installed on the plug 51 if there is further production lower in the wellbore. However, in the situation where zone C is the lowest producing formation and it is producing water in a hydrocarbon well, the need to protect the plug 51 with the low permeability isolation material is probably not necessary as the plug will unlikely ever be recovered. A treating string with a packer is positioned adjacent layer 13 and used to squeeze a treatment into zone C. In the drawings, the zone C is desired to be closed to further production and a production blocker 55 is formed by the high pressure insertion of material that extrudes through the gravel packing, the wire wrapped screen, the space between the wire wrapped screen or other retention filter and the periphery of the base pipe and preferably into the perforations 19 in zone C. Upon complete curing or reaction of the production blocker 55, the wellhole 10 is completely isolated from any fluids in zone C. With the production blocker inside the base pipe 25, and depending on the distance of the production blocker 55 from zone A, a second isolation layer 62 may be installed directly on the production blocker 55. With the isolation layer 62 installed, a fluid seal 64 is installed as described previously with a production blocker 65 installed to seal zone A from the wellbore 10. Again, with zone A sealed from zone B, zone A may alternatively be subjected to a treatment that enhances fluid production in zone A before fluid communication is re-established with zone B. As described in the first embodiment, the production blocker 65 and fluid seal 64 within the base pipe 25 are at least partially removed along with the isolation layer 62 to allow access to the base pipe adjacent zone B as shown in FIG. 6. It should be noted that while it is preferred to open the interior of the base pipe 25 using wireline tools or coiled tubing to minimize rig costs and other expenses, drilling out the production blocker 65 within the base pipe 25 is certainly an option that may be used. Also, if no production is intended in zone C or below, the production blocker 55 is not removed from the inside of the base pipe 25.

It should be noted that the process has been described to stop production in certain zones within the well, but in many other circumstances, it is desirable to stimulate certain formations without subjecting other zones to such stimulation. The technique for stimulating and isolated sections begins by isolating the target zone from the non-target zone. Referring again to FIG. 3, if zone A were deemed to be in need of treatment for which it is desirable not to subject zones B and C to the same treatment, a removable sealing element 41 would be inserted into the base pipe 25 as described before. Layer 42 and fluid seal 44 would also be installed as described before. However, rather than install the production blocker 45, a treatment such as fracturing materials and pressure may be applied or an acid treatment or various kinds of washing may be performed. The inventive technique of the present invention provides for isolation of zone A without forgoing subsequent production of zones B and C by removing the fluid seal within the base pipe 25 after the treatment of zone A has been completed. Production would then resume after removal of the fluid seal 44, the layer 42 and the plug 41 as described before. As should be easily understood, the invention provides for isolating one zone from another and then being able to apply materials under pressure into isolated zones. The fluid seal 44 that remains outside of the base pipe 25 essentially operates as a packer within the casing 15 or to the formation when packers were not originally included in the completion. Once in place with the base pipe 25 opened to the desirable zones, production may be optimized.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

REFERENCES

All of the references cited herein are expressly incorporated by reference. The discussion of any reference is not an admission that it is prior art to the present invention, especially any reference that may have a publication data after the priority date of this application.

The invention claimed is:

1. A process for isolating and treating a first fluid producing zone of an underground formation in an earthen well where the well includes a second fluid producing zone and a filter media within an annular production space extending between a tubular production pipe and the underground formation or casing pipe, where access from the surface through the tubular production pipe to the second fluid producing zone is preserved for subsequent production following the isolating and treating procedure, wherein the process for isolating the first zone comprises:

a) installing a removable sealing element into the tubular production pipe at a level further into the ground than the first fluid producing zone;

b) injecting a settable or reactive low viscosity permeability poison into the tubular production pipe and out into the filter media in the annular production space to fill a segment of the filter media in the annular production space between the first and second fluid producing zones to eventually separate and substantially seal the first and second zones from one another against fluid flow in the filter media in the annular production space;

c) converting the settable or reactive low viscosity permeability poison in the filter media into a fluid seal forming a barrier against flow within a sand control screen in the annular production space;

d) injecting a treatment material into the tubular production pipe onto the fluid seal and through the annular production space and into the formation at the first fluid producing zone; and, e) opening up the interior of the tubular production pipe to regain access to the second fluid producing zone by removing portions of said treatment material, the fluid seal and an isolation material within the tubular production pipe so that fluids may enter the production pipe from the second zone and be extracted to the surface past the now treated first fluid producing zone.

2. The process for isolating and treating a first fluid producing zone in an earthen well according to claim 1, wherein said treatment material includes one or more fluids to increase the fluid production in the first zone.

3. The process for isolating and treating a first fluid producing zone in an earthen well according to claim 1, wherein said treatment material includes one or more fluids to reduce fluid production in the first zone.

4. The process for isolating and treating a first fluid producing zone in an earthen well according to claim 1, wherein said treatment material includes one or more fluids to stop fluid production in the first zone.

5. The process for isolating and treating a first fluid producing zone in an earthen well according to claim 1, wherein the step of opening up the interior of the tubular production pipe further includes removing the removable sealing element.

6. The process for isolating and treating a first fluid producing zone in an earthen well according to claim 1, wherein the step of opening up the interior of the tubular production pipe further includes circulating a fluid to wash a portion of at least one of the fluid seal and the treatment from the tubular production pipe.

7. The process for isolating and treating a first fluid producing zone in an earthen well according to claim 1, wherein the step of opening up the interior of the tubular production pipe further includes drilling a portion of at least one of the fluid seal and the treatment.

8. The process for isolating and treating a first fluid producing zone in an earthen well according to claim 1, wherein a production blocker is forced under elevated pressure into perforations formed into the earthen formation at a non-preferred zone.

9. The process for isolating and treating a first fluid producing zone in an earthen well according to claim 1, wherein said settable or reactive low viscosity permeability poison comprises sodium silicate, ultrafine cement, ringing gels, crosslinked fluids, polymerizing liquids, precipitating liquids or combinations thereof.

10. The process for isolating and treating a first fluid producing zone in an earthen well according to claim 1, wherein said treatment material comprises sodium silicate to block further production in the first zone.

11. The process for isolating and treating a first fluid producing zone in an earthen well according to claim 1, further including the step of depositing a layer of isolation material in the tubular production pipe and onto said removable sealing element to form a low permeability layer therein where a top of the layer is at a level generally between the first and second fluid producing zones before injecting the permeability poison.

12. The process for isolating and treating a first fluid producing zone in an earthen well according to claim 1, wherein the filter media comprises sand, gravel, wrapped wire, extruded metal, wire mesh, ceramic material, or combinations thereof.

13. A process for isolating and treating first and second fluid producing zones of an underground formation in an earthen well that includes a third fluid producing zone generally intermediate of the first and second zones where the second zone is most distant from the surface and the first zone is closest to the surface and the well also includes a filter media within an annular production space extending between a tubular production pipe and the underground formation or casing pipe where access from the surface through the production pipe to the third zone is preserved for subsequent production following the isolating and treating procedures of the first and second zones, where the process for isolating the first and third zones comprises:

a) installing a removable sealing element into the tubular production pipe at a level further into the ground than the second fluid producing zone;

b) injecting a treatment material into the tubular production pipe which is sealed by at least the removable sealing element and through the annular production space and into the formation at the second fluid producing zone;

c) depositing a layer of isolation material into the tubular production pipe above the removable sealing element to form a first low permeability layer therein where at top of the layer is at a level below the first fluid producing zone;

d) injecting a first settable, low viscosity permeability poison onto the isolation material in the production pipe and out into the filter media in the annular production space to fill a segment of the filter media in the annular production space between the first and second fluid producing zones to eventually separate and substantially seal the first and second zones from one another against fluid flow in the filter element in the annular production space;

e) converting the settable, low viscosity permeability poison into a fluid seal forming a barrier against flow within a sand control screen in the annular production space;

f) injecting the treatment material into the tubular production pipe onto the fluid seal and through the annular production space and into the formation at the first fluid producing zone; and f) opening up the interior of the tubular production pipe to regain access to at least the third fluid producing zone by removing portions of the treatment material, the fluid seal and the isolation material within the tubular production pipe so that fluids may enter the production pipe from the third fluid producing zone and be extracted to the surface past the now treated first fluid producing zone.

14. The process for isolating and treating first and second fluid producing zones of an underground formation in an earthen well according to claim 13, wherein the treatment material for the first zone includes one or more fluids to increase the fluid production in the first zone.

15. The process for isolating and treating first and second fluid producing zones of an underground formation in an earthen well according to claim 14, wherein the treatment material for the second zone includes one or more fluids to increase the fluid production in the second zone.

16. The process for isolating and treating first and second fluid producing zones of an underground formation in an earthen well according to claim 14, wherein the treatment material for the second zone includes one or more fluids to stop the fluid production in the second zone.

17. The process for isolating and treating first and second fluid producing zones of an underground formation in an earthen well according to claim 13, wherein the treatment material for the first zone includes one or more fluids to stop the fluid production in the first zone.

18. The process for isolating and treating first and second fluid producing zones of an underground formation in an earthen well according to claim 17, wherein the treatment material for the second zone includes one or more fluids to increase the fluid production in the second zone.

19. The process for isolating and treating first and second fluid producing zones of an underground formation in an earthen well according to claim 17, wherein the treatment material for the second zone includes one or more fluids to stop the fluid production in the second zone.

20. A process for isolating and treating a fluid producing zone of an underground formation in an earthen well that includes at least one additional fluid producing zone and the well also includes a filter media within an annular production space extending between a tubular production pipe and the underground formation or casing pipe where access from the surface through the production pipe to the additional fluid producing zone is preserved for subsequent production following the isolating and treating procedures of the fluid producing zone, where the process for isolating the fluid producing zone comprises:

a) installing a removable sealing element into the tubular production pipe at a level further along than the additional fluid producing zone;

b) injecting a treatment material into the tubular production pipe which is sealed by at least the removable sealing element and through the annular production space and into the formation at the additional fluid producing zone;

c) depositing a layer of isolation material into the tubular production pipe before the removable sealing element to form a first low permeability layer therein where the layer is after the fluid producing zone;

d) injecting a first settable, low viscosity permeability poison onto the isolation material in the production pipe and out into the filter element in the annular production space to fill a segment of the filter element in the annular production space to eventually substantially seal the fluid producing zone against fluid flow in the filter element in the annular production space;

e) converting the first settable, low viscosity permeability poison into a fluid seal forming a barrier against flow within a sand control screen in the annular production space;

f) injecting the treatment material into the tubular production pipe onto the fluid seal and through the annular production space and into the formation at the fluid producing zone; and g) opening up the interior of the tubular production pipe to regain access to at least the additional fluid producing zone by removing portions of the treatment material, the fluid seal and the isolation material within the tubular production pipe so that fluids may enter the production pipe from the additional fluid producing zone and be extracted to the surface past the now treated fluid producing zone.

21. The process for isolating and treating the fluid producing zone of an underground formation in an earthen well according to claim 20, wherein the treatment material for the fluid producing zone includes one or more fluids to increase the fluid production in the fluid producing zone.

22. The process for isolating and treating the fluid producing zone of an underground formation in an earthen well according to claim 21, wherein the treatment material for the fluid producing zone includes one or more fluids to stop the fluid production in the fluid producing zone.

* * * * *